US007094043B2

(12) United States Patent
Skinner

(10) Patent No.: US 7,094,043 B2
(45) Date of Patent: Aug. 22, 2006

(54) COMPRESSOR HAVING COUNTERWEIGHT SHIELD

(75) Inventor: Robin G Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 187 days.

(21) Appl. No.: 10/657,310

(22) Filed: Sep. 8, 2003

(65) Prior Publication Data

US 2004/0057857 A1 Mar. 25, 2004

Related U.S. Application Data

(60) Provisional application No. 60/412,838, filed on Sep. 23, 2002.

(51) Int. Cl.
*F01C 1/02* (2006.01)
*F04C 18/00* (2006.01)

(52) U.S. Cl. ..... 418/55.6; 418/55.1; 418/89; 418/94; 418/96; 184/6.17

(58) Field of Classification Search ..... 418/88, 418/89, 94, 55.6, 55.1; 184/6.16
See application file for complete search history.

(56) References Cited

U.S. PATENT DOCUMENTS

| | | | | |
|---|---|---|---|---|
| 2,661,172 | A | 12/1953 | Needham | |
| 3,039,725 | A | 6/1962 | Kerley, Jr. | |
| RE25,569 | E | 5/1964 | Coron et al. | |
| 3,145,960 | A | 8/1964 | Langdon | |
| 3,749,340 | A | 7/1973 | Williams et al. | |
| 3,785,167 | A | 1/1974 | Sahs | |
| 4,089,613 | A | 5/1978 | Babbitt, Jr. | |
| 4,244,680 | A | 1/1981 | Ishizuka et al. | |
| 4,389,171 | A | 6/1983 | Eber et al. | |
| 4,416,594 | A | 11/1983 | Ichikawa | |
| 4,497,615 | A | 2/1985 | Griffith | |
| 4,518,276 | A | 5/1985 | Mitchell et al. | |
| 4,552,518 | A | 11/1985 | Utter | |
| 4,557,677 | A | 12/1985 | Hasegawa | |
| 4,685,188 | A | 8/1987 | Goy | |
| 4,767,293 | A | 8/1988 | Caillat et al. | |
| 4,792,288 | A | 12/1988 | Gromoll et al. | |
| 4,818,198 | A | 4/1989 | Tamura et al. | |
| 4,877,382 | A | 10/1989 | Caillat et al. | |
| 4,895,496 | A * | 1/1990 | Elson | 417/372 |
| 4,992,033 | A | 2/1991 | Caillat et al. | |
| 5,012,896 | A | 5/1991 | Da Costa | |
| 5,055,010 | A | 10/1991 | Logan | |
| 5,062,779 | A | 11/1991 | Da Costa | |

(Continued)

FOREIGN PATENT DOCUMENTS

| | | | |
|---|---|---|---|
| FR | 2 755 477 | A1 | 11/1997 |

(Continued)

*Primary Examiner*—Theresa Trieu
(74) *Attorney, Agent, or Firm*—Baker & Daniels

(57) ABSTRACT

A compressor having a housing and mutually engaged stationary and orbiting scrolls. A crankcase is disposed between a motor and the orbiting scroll. A shaft is operably connected with the orbiting scroll and extends through the crankcase and the motor. The end of the shaft extending from the motor is rotatably supported by a bearing mounted in a bearing support. A counterweight is rotationally coupled with the shaft proximate the bearing support. An oil sump is disposed within the housing and an oil shield is fixed to the bearing support. The oil shield has a cylindrical portion with an open end which encircles the counterweight and may include a plurality of flexible members having inwardly bent portions which engage a groove on the bearing support.

13 Claims, 7 Drawing Sheets

U.S. PATENT DOCUMENTS 5,064,356 A * 11/1991 Horn ..... 418/55.6
5,110,268 A * 5/1992 Sakurai et al. ..... 418/55.6
5,114,322 A 5/1992 Caillat et al.
5,137,437 A 8/1992 Machida et al.
5,176,506 A * 1/1993 Siebel ..... 418/94
5,211,031 A 5/1993 Murayama et al.
RE34,297 E 6/1993 Elson
5,219,281 A 6/1993 Caillat et al.
5,222,885 A 6/1993 Cooksey
5,224,845 A 7/1993 Mangyo et al.
5,240,391 A 8/1993 Ramshankar et al.
5,247,738 A 9/1993 Yoshii
5,312,234 A 5/1994 Yoshii
5,345,785 A 9/1994 Sekigami et al.
5,345,970 A 9/1994 Leyderman et al.
5,346,375 A 9/1994 Akiyama et al.
5,348,455 A 9/1994 Herrick et al.
5,370,156 A 12/1994 Peracchio et al.
5,372,490 A * 12/1994 Fain ..... 418/55.6
5,391,066 A 2/1995 Sawai et al.
5,427,511 A 6/1995 Caillat et al.
5,474,433 A 12/1995 Chang et al.
5,487,648 A 1/1996 Alfano et al.
5,522,715 A 6/1996 Watanabe et al.
5,531,577 A 7/1996 Hayase et al.
5,533,875 A 7/1996 Crum et al.
5,579,651 A 12/1996 Sugiyama et al.
5,580,233 A 12/1996 Wakana et al.
5,597,293 A 1/1997 Bushnell et al.
5,597,296 A 1/1997 Akazawa et al.
5,634,781 A 6/1997 Yoshida et al.
5,645,408 A 7/1997 Fujio et al.
5,660,539 A 8/1997 Matsunaga et al.
5,683,237 A 11/1997 Hagiwara et al.
5,695,326 A 12/1997 Oka et al.
5,716,202 A 2/1998 Koyama et al.
5,720,601 A 2/1998 Tark et al.
5,745,992 A 5/1998 Caillat et al.
5,752,688 A 5/1998 Campbell et al.
5,769,126 A 6/1998 Cho
5,772,411 A 6/1998 Crum et al.
5,772,416 A 6/1998 Caillat et al.
5,775,894 A 7/1998 Kosco, Jr.
5,810,572 A 9/1998 Yamamoto et al.
5,829,959 A 11/1998 Tsubono et al.
5,863,190 A 1/1999 Yamamoto et al.
5,913,892 A 6/1999 Kwon
5,931,649 A 8/1999 Caillat et al.
5,931,650 A 8/1999 Yasu et al.
5,947,709 A 9/1999 Koyama et al.
5,964,581 A 10/1999 Iizuka et al.
6,000,917 A 12/1999 Smerud et al.
6,011,336 A 1/2000 Mathis et al.
6,027,321 A 2/2000 Shim et al.
6,039,551 A 3/2000 Takeuchi et al.
6,050,794 A 4/2000 Noboru et al.
6,056,523 A 5/2000 Won et al.
6,106,254 A 8/2000 Hirooka et al.
6,132,191 A 10/2000 Hugenroth et al.
6,139,291 A 10/2000 Perevozchikov
6,156,106 A 12/2000 Kamata
6,162,035 A 12/2000 Hayano et al.
6,167,719 B1 1/2001 Yakumaru et al.
6,171,076 B1 1/2001 Gannaway
6,179,589 B1 1/2001 Bass et al.
6,186,753 B1 2/2001 Hugenroth et al.
6,224,356 B1 5/2001 Dewar et al.
6,227,830 B1 5/2001 Fields et al.
6,247,910 B1 6/2001 Yokoyama
6,261,073 B1 7/2001 Kumazawa
6,264,446 B1 7/2001 Rajendran et al.
6,280,154 B1 8/2001 Clendenin et al.
6,299,423 B1 10/2001 Perevozchikov
6,305,912 B1 10/2001 Svendsen et al.
6,322,339 B1 * 11/2001 Mitsunaga et al. ..... 418/94
6,402,485 B1 6/2002 Hong et al.
2001/0006603 A1 7/2001 Hong et al.
2001/0055536 A1 12/2001 Bernardi et al.

FOREIGN PATENT DOCUMENTS

JP 61087994 5/1986
JP 402061382 A 3/1990
JP 05180178 A * 7/1993
JP 05288171 A 11/1993
JP 06235387 A * 8/1994
JP 407259764 A 10/1995
JP 410148191 A 6/1998
JP 02001020881 A 1/2001
JP 2001271752 A 10/2001
JP 2002021729 A 1/2002
JP 2002098056 A 4/2002

* cited by examiner

COMPRESSOR HAVING COUNTERWEIGHT SHIELD

CROSS REFERENCE TO RELATED APPLICATIONS

This application claims priority under 35 U.S.C. 119(e) of U.S. provisional patent application Ser. No. 60/412,838 filed on Sep. 23, 2002 entitled COMPRESSOR HAVING COUNTERWEIGHT SHIELD the disclosure of which is hereby incorporated by reference.

BACKGROUND OF THE INVENTION

1. Field of the Invention

The present invention relates to compressors and, more particularly, compressors having a rotatable counterweight with a shield surrounding the counterweight.

2. Description of the Related Art

Conventional compressor designs often include a rotating shaft which is eccentrically loaded, such as a shaft coupled to the orbiting scroll in a scroll compressor. Such eccentrically loaded shafts typically include counterweights which may be mounted directly to the shaft or located on the rotor of a motor which is coupled to the shaft. Although shielding for such counterweights is known, an improved shielding assembly for such counterweights is desirable.

SUMMARY OF THE INVENTION

The present invention provides a compressor having an improved shielding assembly for counterweight wherein the shielding is mounted to a bearing support for the shaft and has a generally cylindrical section for surrounding a counterweight. The shielding may include flexible tabs having inwardly bent portions for engaging a groove or recess on the bearing support and thereby mounting the shield to the bearing support.

The invention comprises, in one form thereof, a compressor assembly. The compressor assembly includes a housing, a compressor mechanism disposed within the housing and a bearing support mounted within the housing. A shaft, rotatable about a shaft axis which is disposed substantially horizontally during operation of the compressor assembly, is also provided. The shaft has first and second opposed ends wherein the first end is operably coupled to the compressor mechanism. A bearing is mounted on the bearing support and rotatably supports the shaft proximate the second end of the shaft. A counterweight is rotationally coupled with the shaft and disposed proximate the second end of the shaft. The housing defines an interior plenum wherein lubricating oil is pooled in a bottom portion of the interior plenum and wherein the bearing support, the bearing, the counterweight and the shaft are all disposed within the interior plenum. The assembly also includes an oil shield having a plurality of flexible members which mount the oil shield to the bearing support proximate the bearing. The oil shield has a substantially cylindrical portion extending outwardly from the bearing support and the counterweight is at least partially disposed within the substantially cylindrical portion of the oil shield.

The invention comprises, in another form thereof, a compressor assembly which includes a housing, a stationary scroll member fixed within the housing, and an orbiting scroll member disposed within the housing and engaged with the stationary scroll member. The assembly also includes a motor and a crankcase with the crankcase being disposed between the motor and the orbiting scroll member. A bearing support member is fixed within the housing and has a bearing mounted thereto. An elongate shaft rotatable about a shaft axis and having a first end and an opposite second end extends through the crankcase and the motor. The first end of the shaft is operably coupled with the orbiting scroll member and the bearing rotatably supports the shaft proximate the second end. The shaft axis is disposed substantially horizontally during operation of the compressor. A counterweight is rotationally coupled with the shaft proximate the bearing support member and an oil sump is disposed within an interior plenum defined by the housing. An oil shield having a plurality of flexible members mounting the oil shield to the bearing support is also provided. The oil shield has a substantially cylindrical portion extending outwardly from the bearing support and encircling at least a portion of the counterweight.

In such compressor assemblies, each of the plurality of flexible members may have has a distal end with a radially inwardly projecting portion wherein the inwardly projecting portions are engageable with a groove or recess defined by the bearing support and located proximate the bearing. The bearing support may also include a substantially cylindrical central portion wherein the bearing is mounted within the central portion and the oil shield fixedly engages an outer surface of the central portion. A groove or recess for engaging inwardly projecting portions of the flexible members may be located on the outer surface of the central portion. The counterweight may be disposed on a rotor rotationally coupled to the shaft.

An advantage of the present invention is that it provides a shield which is readily attachable to a bearing support that prevents the fanning action of a counterweight from agitating oil pooled within the compressor housing proximate the counterweight.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
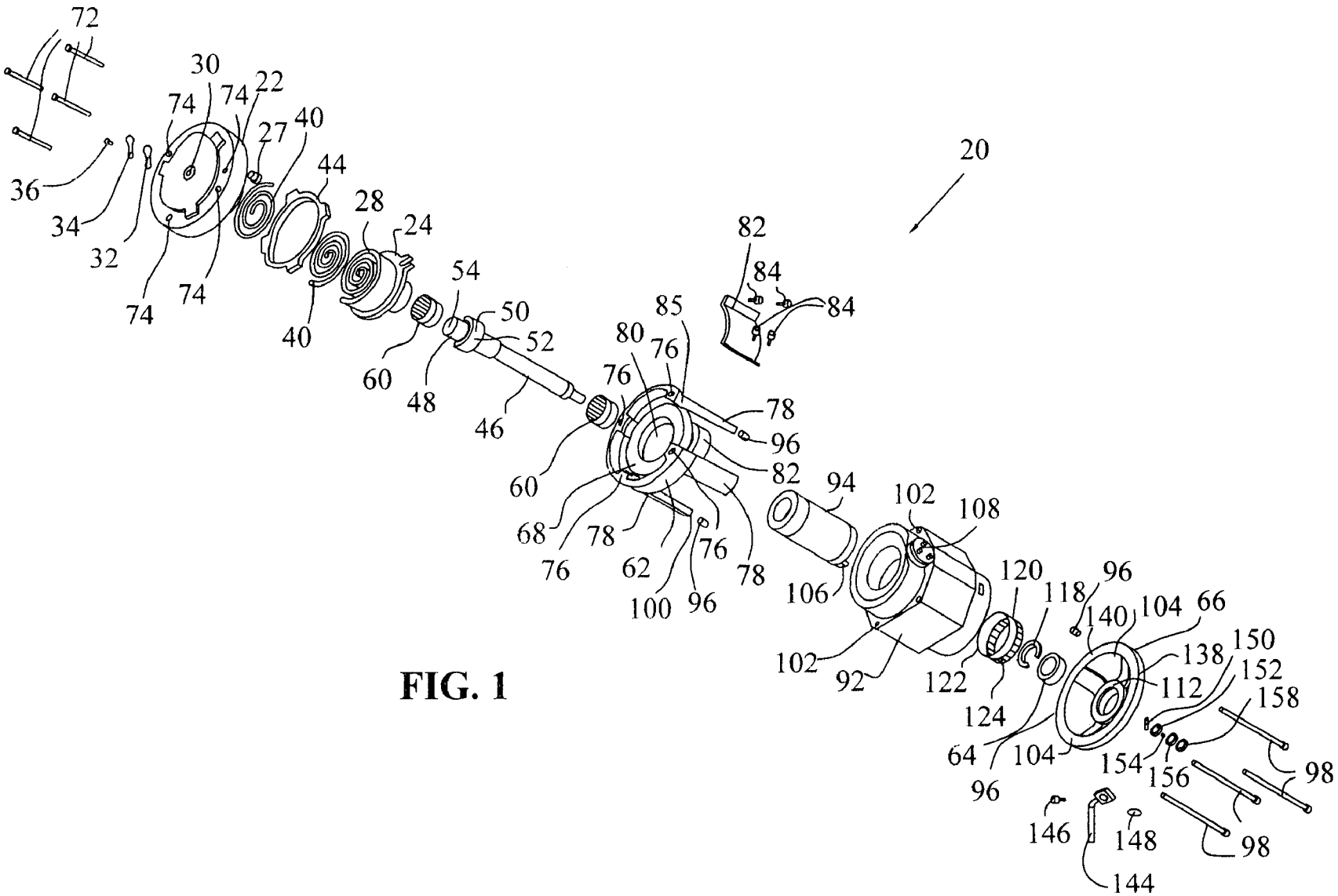
FIG. 1 is an exploded view of a scroll compressor in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, a scroll compressor 20 is shown in an exploded view in FIG. 1. Scroll compressor 20 includes a fixed or stationary scroll member 22 which is engaged with an orbiting scroll member 24. Fixed and orbiting scroll members 22, 24 respectively include an involute wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member.

A one-way valve allows compressed refrigerant to be discharged into a discharge chamber or plenum 38 and prevents compressed refrigerant located in discharge plenum 38 from reentering discharge port 30. The valve includes an exhaust valve leaf 32 which sealingly engages fixed scroll member 22 at discharge port 30 and an exhaust valve retainer 34. Valve leaf 32 is secured between fixed scroll member 22 and valve retainer 34. Valve retainer 34 has a bend at its distal end which allows valve leaf 32 to flex outwardly away from discharge port 30 when gas is compressed between scroll members 22, 24 and thereby permit the passage of high pressure gas into discharge plenum 38. Valve retainer 34 limits the extent to which valve leaf 32 may flex outwardly away from discharge port 30 to prevent damage from excessive flexing of valve leaf 32. A threaded fastener 36 secures valve retainer 34 and valve leaf 32 to fixed scroll member 22. An alternative valve that may be used with compressor 20 is described by Haller et al. in U.S. Provisional Patent Application Ser. No. 60/412,905 entitled COMPRESSOR HAVING DISCHARGE VALVE filed on Sep. 23, 2002 which is hereby incorporated herein by reference. Pressure relief valve 27 is positioned between scroll members 22, 24 to allow discharge pressure gas to be directed into the suction pressure inlet in the event of overpressurization.

An Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension 48 on shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall 52 which eccentrically loads shaft 46 to counterbalance the eccentric loading of shaft 46 by orbiting scroll 24. Counterweight 50 is heat shrink fitted onto shaft 46 in the disclosed embodiment. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and crankcase 62. A ball bearing 64 is positioned near the opposite end of shaft 46 and is mounted within bearing support 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM which is hereby incorporated herein by reference.

Crankcase 62 is secured to fixed scroll 22 with threaded fasteners 72 which pass through apertures 74 located in fixed scroll 22 and engage threaded bores 76 in crankcase 62. Crankcase 62 includes a thrust surface 68 which slidably engages orbiting scroll 24 and restricts movement of orbiting scroll 24 away from fixed scroll 22. Crankcase 62 also includes four legs 78 which secure the crankcase to stator 92 as described in greater detail below. Shaft 46 extends through opening 80 in crankcase 62. Crankcase 62 includes a shroud portion 70 which is disposed between legs 78 in the lower portion of the horizontal compressor housing and partially encloses a space within which counterweight 50 rotates. Shroud 70 includes an opening 81 along its upper portion which permits the equalization of pressure between the space partially enclosed by shroud 70 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

Figure 4:
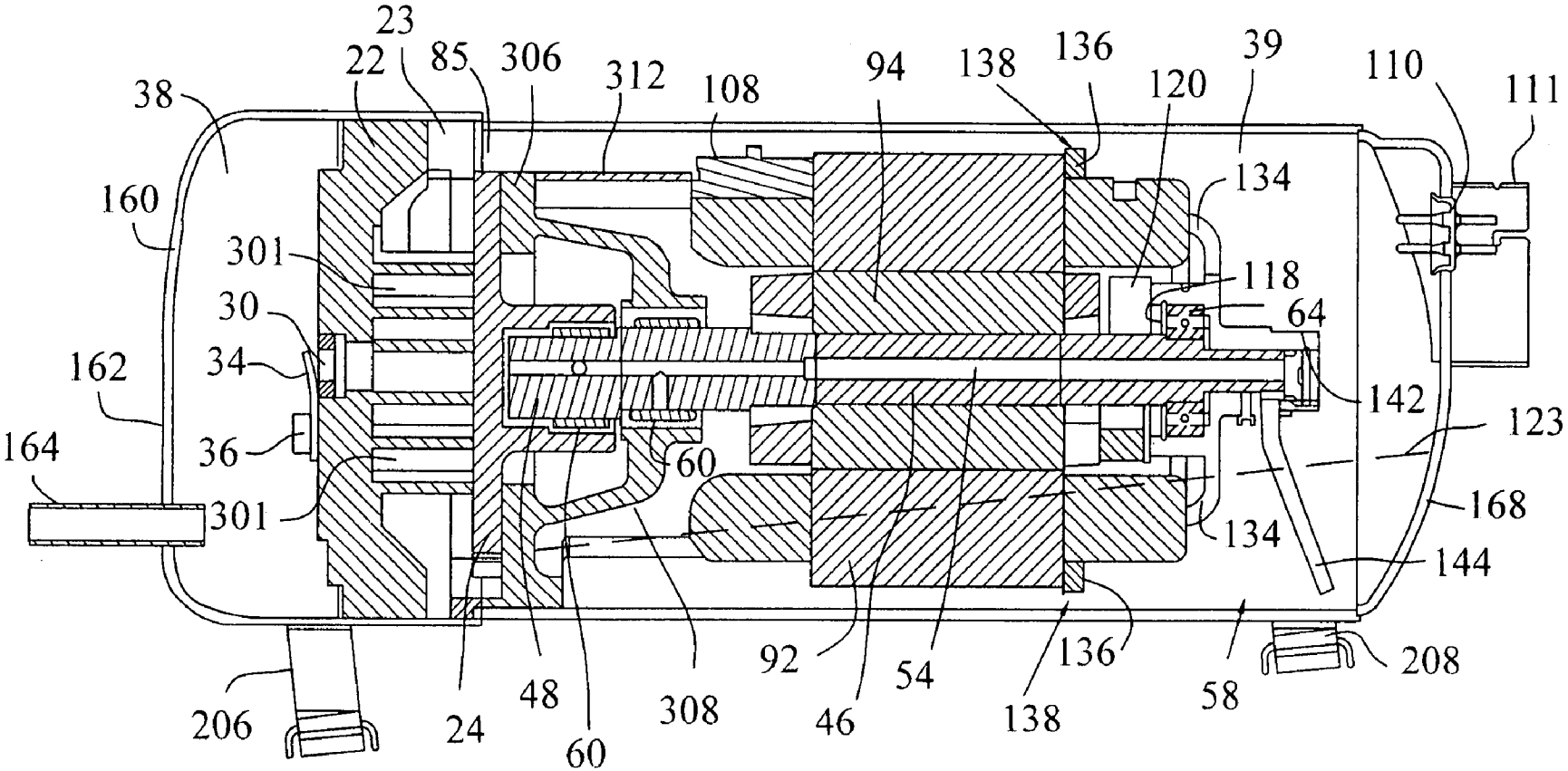
FIG. 4 is a sectional view of the compressor of FIG. 2 taken along line 4—4.

A suction baffle 82 (FIG. 1) is secured between two legs 78 using fasteners. The illustrated fasteners are socket head cap screws 84 but other fasteners such as self-tapping screws and other fastening methods may also be used to secure suction baffle 82. Suction baffle 82 is positioned proximate inlet tube 86 as best seen in FIG. 4. Refrigerant enters compressor housing 88 through inlet tube 86 and suction baffle 82 is positioned in the flow path of entering refrigerant to redirect the refrigerant along the outer perimeter of crankcase 62. The outer perimeter of crankcase 62 includes a recess 85 adjacent suction baffle 82 which defines a passage to inlet 23. Crankcase 62 includes a sleeve portion 89 in which roller bearing 60 is mounted for rotatably supporting shaft 46. Sleeve 89 is supported by shroud portion 70 opposite opening 80. An alternative crankcase and suction baffle assembly may include an inlet to housing 88 located at mid-height wherein the suction baffle has a narrow opening located between inlet 86 and inlet 23 which extends transverse to the flow direction of refrigerant along the suction baffle to strip oil from the suction baffle. Crankcases and suction baffles which may be used with compressor 20 are described by Haller, et al. in U.S. Provisional Patent Application Ser. No. 60/412,768 entitled COMPRESSOR ASSEMBLY filed on Sep. 23, 2002 which is hereby incorporated herein by reference.

A motor 90 is disposed adjacent crankcase 62 and includes a stator 92 and a rotor 94. Bushings 96 are used to properly position stator 92 with respect to crankcase 62 and bearing support 66 when assembling compressor 20. During assembly, crankcase 62, motor 90 and bearing support 66 must have their respective bores through which shaft 46 is inserted precisely aligned. Smooth bore pilot holes 100, 102, 104 which are precisely located relative to these bores are provided in crankcase 62, motor 90 and bearing support 66.

Alignment bushings 96 fit tightly within the pilot holes to properly align crankcase 62, motor 90 and bearing support 66. Bolts 98 (FIG. 1) are then used to secure bearing support 66, motor 90 and crankcase 62 together. Pilot holes 100 are located on the distal ends of legs 78 in crankcase 62 and bolts 98 are threaded into engagement with threaded portions of holes 100 when securing crankcase 62, motor 90 and bearing support 66 together. Pilot holes 102 located in stator 92 of motor 90 extend through stator 92 and allow the passage of bolts 98 therethrough. Pilot holes 104 located in bearing support 66 also allow the passage of the shafts of bolts 98 therethrough but prevent the passage of the heads of bolts 98 which bear against bearing support 66 when bolts 98 are engaged with crankcase 62 to thereby secure crankcase 62, motor 90 and bearing support 66 together. In the disclosed embodiment, bushings 96 are hollow sleeves and bolts 98 are inserted through bushings 96. Alternative embodiments, however, could employ pilot holes and bushings to properly align crankcase 62, motor 90 and bearing support 66 with different methods of securing these parts together. For example, the pilot holes could be separate from the openings through which bolts 98 are inserted or alternative methods of securing crankcase 62, motor 90 and bearing support 66 together could be employed with the use of pilot holes and alignment bushings 96. Alignment bushings which may be used with compressor 20 are described by Skinner in U.S. Provisional Patent Application Ser. No. 60/412,868 entitled COMPRESSOR HAVING ALIGNMENT BUSHINGS AND ASSEMBLY METHOD filed on Sep. 23, 2002 which is hereby incorporated herein by reference.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate bearing support 66. Similar to counterweight 50, counterweight 106 located on rotor 94 acts to counterbalance the eccentric load placed on shaft 46 by orbiting scroll 24. Although counterweight 106 is not directly mounted to shaft 46, rotor 94 is rotationally secured to shaft 46 and counterweight 106 rotates with shaft 46, i.e., counterweight 106 is rotationally coupled to shaft 46.

Figure 5:
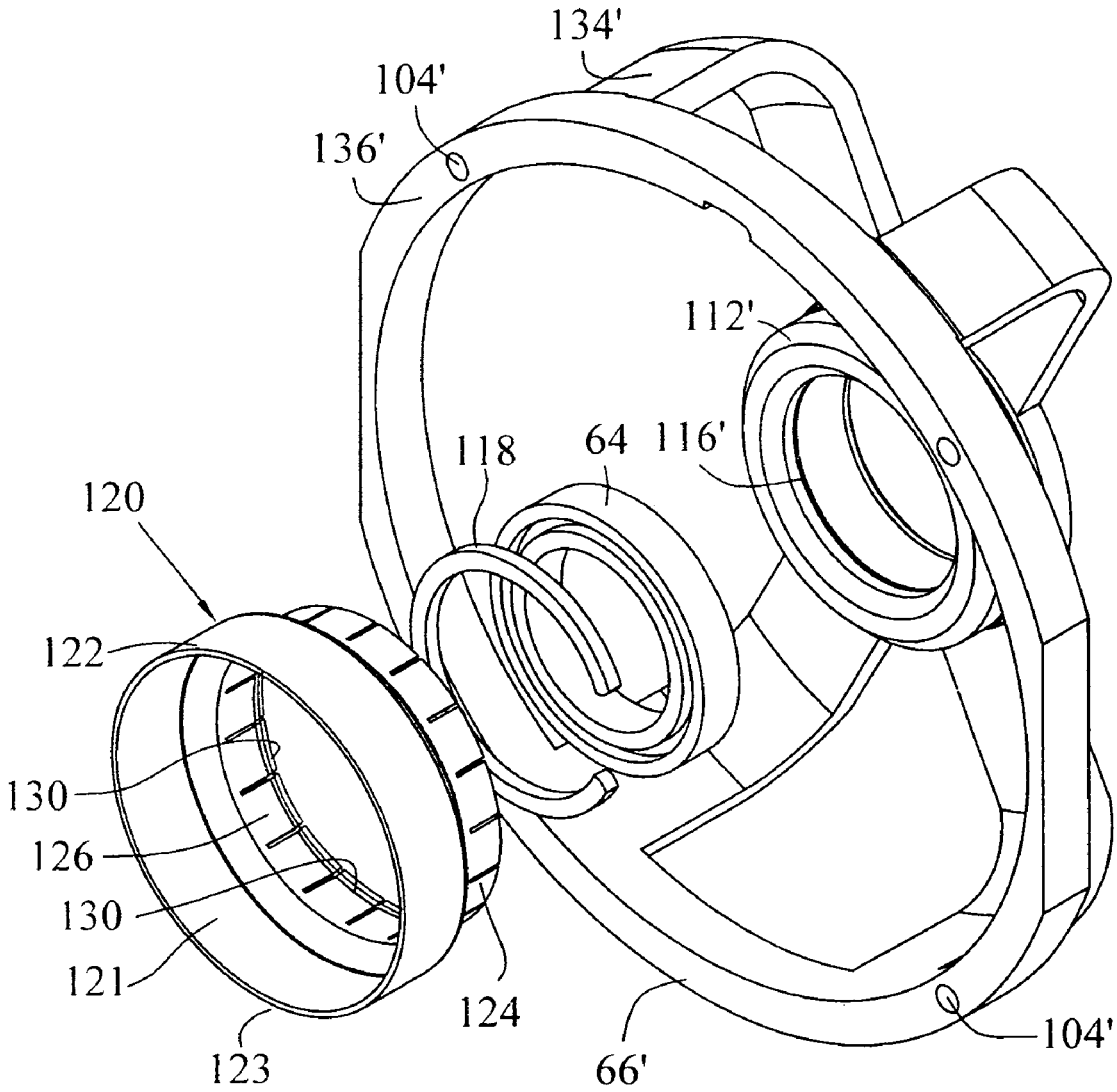
FIG. 5 is an exploded view of a bearing support assembly including an oil shield.

As can be seen in FIG. 5, the distal end 123 of oil shield 120 forms a rim which defines an opening or open end 121 through which counterweight 106 may be inserted during assembly of compressor 20.

As mentioned above, shaft 46 is rotatably supported by ball bearing 64 which is mounted in bearing support 66. Bearing support 66 includes a substantially cylindrical central portion or boss 112 which defines a substantially cylindrical opening 114 in which ball bearing 64 is mounted. A retaining ring 118 is fitted within a groove 116 located in the interior of opening 114 to retain ball bearing 64 within boss 112. An oil shield 120 is secured to boss 112 and has a cylindrical portion 122 which extends towards motor 90 therefrom. Counterweight 106 is disposed within the space circumscribed by cylindrical portion 122 and is thereby shielded from the oil located in oil sump 58, although it is expected that the oil level 123 will be below oil shield 120 under most circumstances, as shown in FIG. 4. Oil shield 120 is positioned so that it inhibits the impacting of counterweight 106 on oil migrating to oil sump 58 and also inhibits the agitation of oil within oil sump 58 which might be caused by the movement of refrigerant gas created by the rotation of eccentrically positioned counterweight 106. A second substantially cylindrical portion 124 of oil shield 120 has a smaller diameter than the first cylindrical portion 122 and has a plurality of longitudinally extending flexible members or tabs 126. Distal ends 128 of tabs 126 have radially inwardly projecting portions 130. Boss 112 includes a circular groove, or recess. 132 on its exterior surface and oil shield 120 is secured to boss 112 by positioning tabs 126 along the exterior surface of boss 112 with radially inwardly bent portions 130 extending into groove 132.

Figure 7:
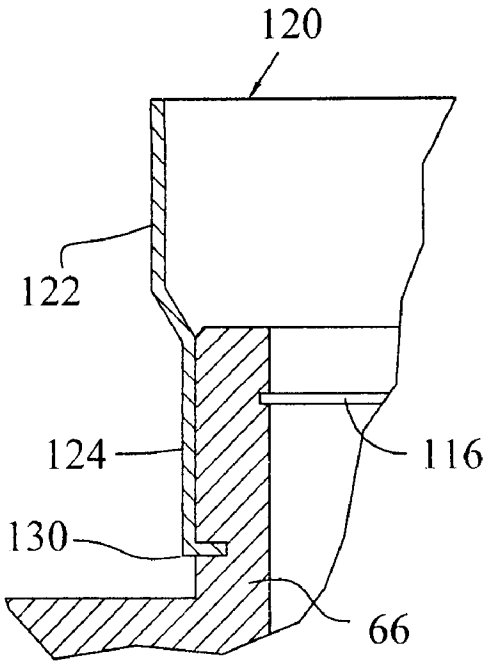
FIG. 7 is a partial cross sectional view of a bearing support with attached oil shield.
Figure 6:
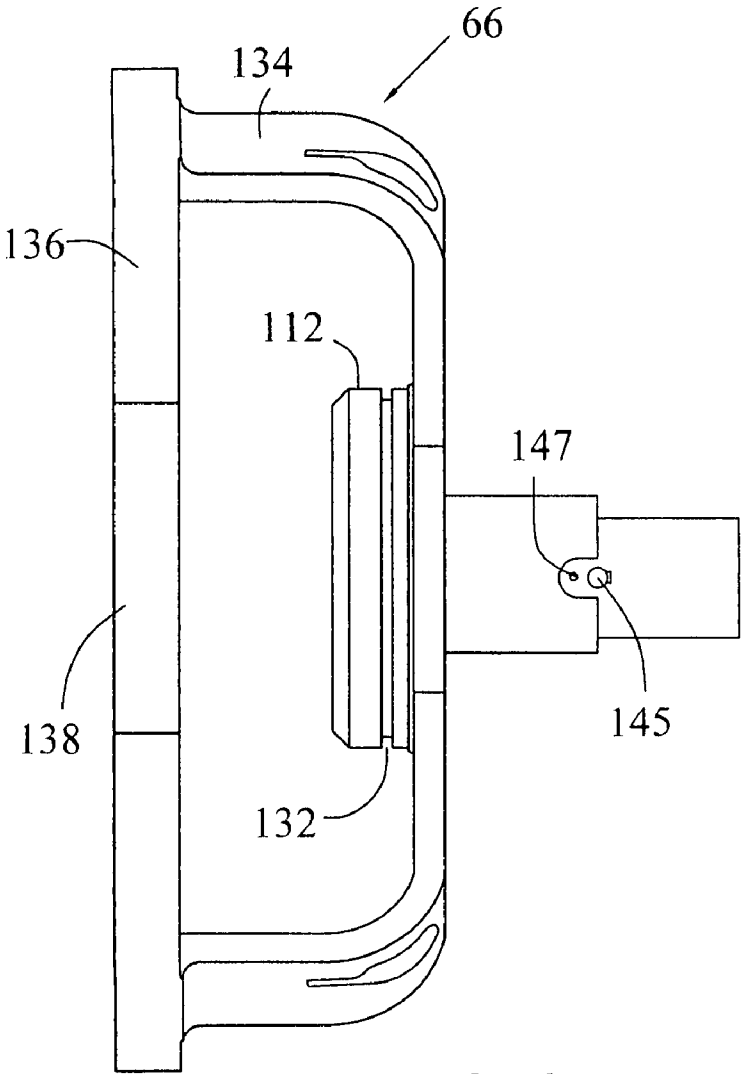
FIG. 6 is a side view of a bearing support.
Figure 9:
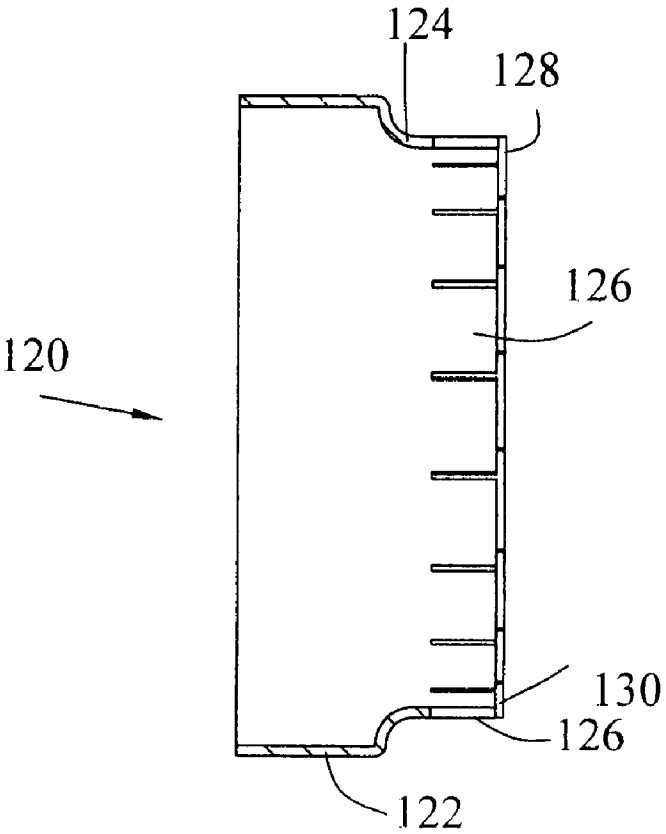
FIG. 9 is a cross sectional view taken along line 9—9 of FIG. 8.
Figure 8:
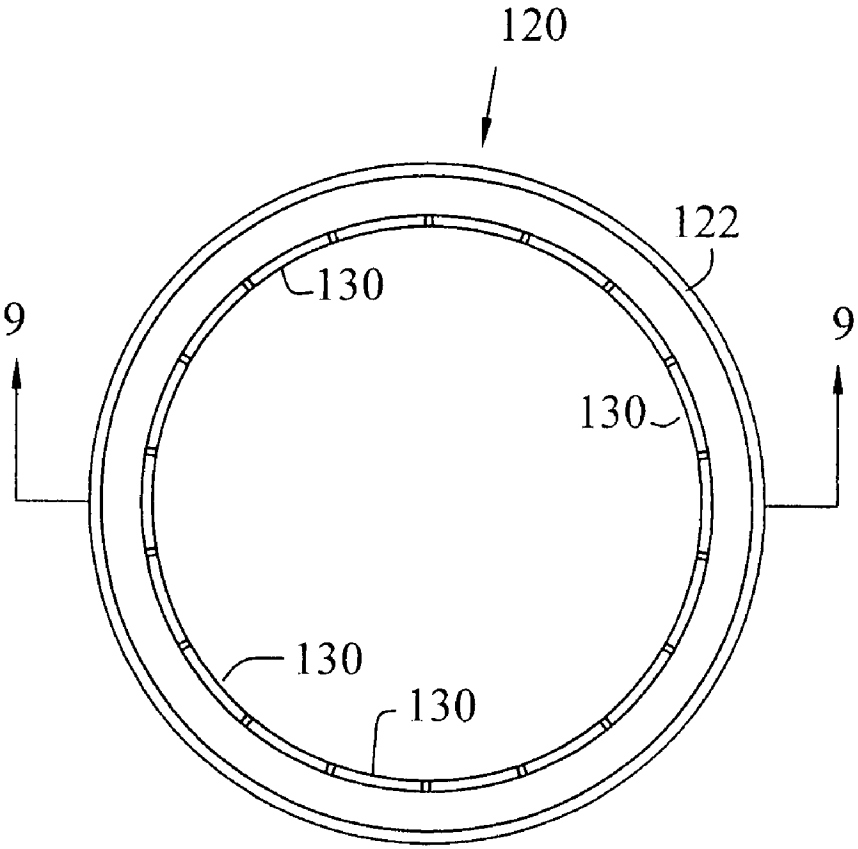
FIG. 8 is a top view of an oil shield.
Figure 2:
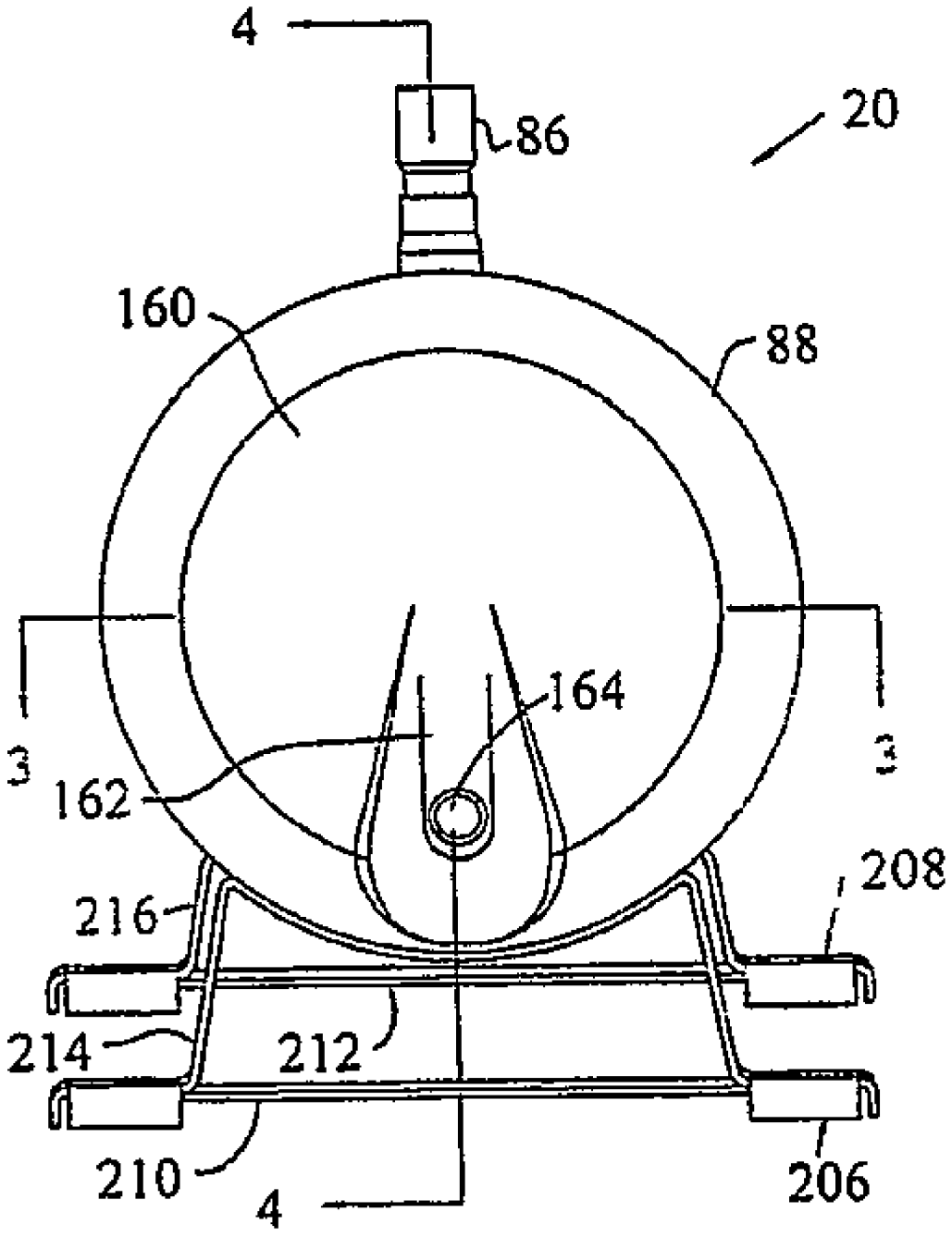

A second embodiment of a bearing support 66' which may be used with the present invention is shown in FIG. 5. Those features of bearing support 66' which are similar to the first embodiment use prime reference numerals wherein the reference numeral is the same as in the first embodiment. FIG. 5 illustrates an exploded view of a bearing support 66', bearing 64, retaining clip 118 and oil shield 120. Bearing 64 is retained within boss 112' by engaging retaining clip 118 with groove 116'. Bearing support 66' is similar to bearing support 66 but does not include an integral extension on its rear surface for attaching an oil pick up tube. Instead, an assembly including an oil pick up tube and mechanism for pumping the oil is secured to the rear surface of bearing support 66'. Such oil pickup assemblies are well known in the art. Outer ring 136' and support arms 134' also differ from outer ring 136 and support arms 134 of bearing support 66 in that openings 104' do not intersect support arms 134'. Groove, or recess, 132 located on the exterior of boss 112 can be seen in FIG. 6 which provides a side view of bearing support 66. Bearing support 66' includes a similar circular groove located on its exterior for engagement with inwardly bent portions 130. A cross sectional view illustrating the engagement of inwardly bent portions 130 with groove 132 is shown in FIG. 7. FIGS. 8 and 9 provide additional views of oil shield 120.

Oil shield 120 may be manufactured using a polymer material and machining operations. One suitable polymer material which may be used when shield 120 will be machined is Hydex 4101 available from ALRO Plastics having a place of business in Jackson, Mich. Oil shield 120 may also be injection molded and a polymer suitable for use in the injection molding of oil shield 120 is Valox 310 available from General Electric.

Support arms 134 extend between boss 112 and outer ring 136 of bearing support 66. The outer perimeter of ring 136 is press fit into engagement with housing 88 to secure bearing support 66 therein. The interior perimeter of outer ring 136 faces the windings of stator 92 when bearing support 66 is engaged with motor 90. Flats 138 are located on the outer perimeter of ring 136 and the upper flat 138 facilitates the equalization of pressure within interior plenum by allowing refrigerant to pass between outer ring 136 and housing 88. Flat 138 located along the bottom of ring 136 allows oil in oil sump 58 to pass between ring 136 and housing 88. A notch 140 located on the interior perimeter of outer ring 136 may be used to locate bearing support 66 during machining of bearing support 66 and also facilitates the equalization of pressure within suction plenum 39 by allowing refrigerant to pass between stator 92 and ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An O-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 112. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in U.S. Provisional Patent Application Ser. No. 60/412,890 entitled COMPRESSOR HAVING BEARING SUPPORT filed on Sep. 23, 2002 which is hereby incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
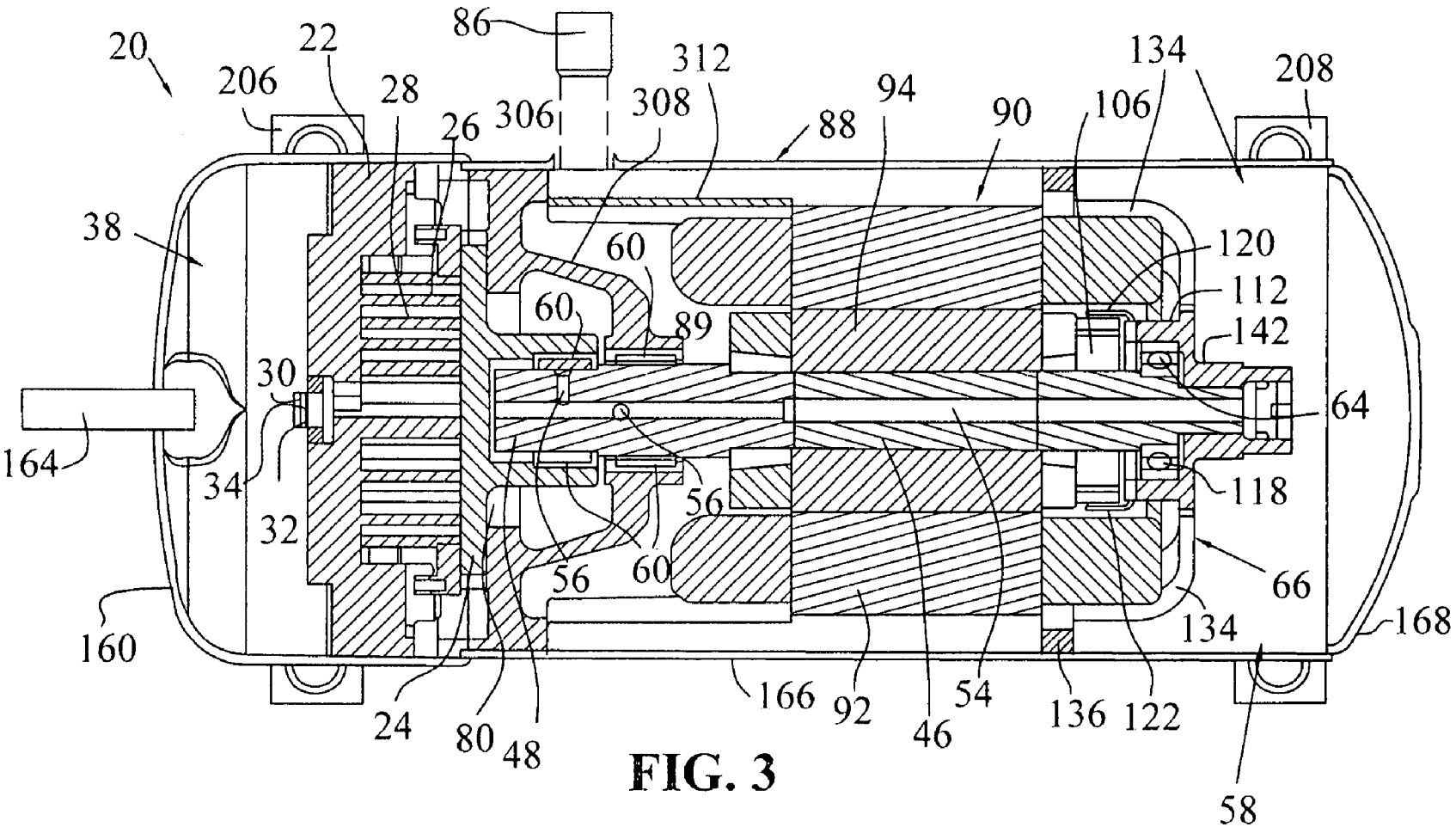
FIG. 3 is a sectional view of the compressor of FIG. 2 taken along line 3—3.

As can be seen in FIGS. 3 and 4, compressor housing 88 includes a discharge end cap 160 having a relatively flat portion 162. Housing 88 also includes a cylindrical shell 166 and rear end cap 168. End caps 160, 168 are welded to cylindrical shell 166 to provide an hermetically sealed enclosure. A discharge tube 164 extends through an opening in flat portion 162. The securement of discharge tube 164 to end cap 160 by welding or brazing is facilitated by the use of flat portion 162 immediately surrounding the opening through which discharge tube 164 is positioned.

After the compressor and motor subassembly is assembled and shrink-fitted into cylindrical housing shell 166, fixed scroll member 22 is positioned within discharge end cap 160 and tightly engages the interior surface of end cap 160. Discharge plenum 38 is formed between discharge end cap 160 and fixed scroll member 22. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 is located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Although the disclosed embodiment utilizes a short, straight length of tubing to provide discharge tube 164, alternative embodiments of the discharge outlet may also be used. A discharge plenum configuration which may be used with compressor 20 is described by Skinner in U.S. Provisional Patent Application Ser. No. 60/412,871 entitled COMPRESSOR DISCHARGE ASSEMBLY filed on Sep. 23, 2002 which is hereby incorporated herein by reference.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 (FIG. 2) by a swaging operation. The mounting brackets used with compressor 20 may be those described by Skinner in U.S. Provisional Patent Application Ser. No. 60/412,884 entitled COMPRESSOR MOUNTING BRACKET AND METHOD OF MAKING filed on Sep. 23, 2002 which is hereby incorporated herein by reference. Alternative mounting brackets may also be employed. For example, mounting brackets formed by support members similar to members 214 and 216 but which have been given greater rigidity by bending their outer edges downward along the full length of the support members may be used without a crossbrace to support compressor 20.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a housing;

a compressor mechanism disposed within said housing;

a bearing support mounted within said housing, said bearing support including a recess;

a shaft rotatable about a shaft axis, said shaft axis being disposed substantially horizontally during operation of said compressor assembly, said shaft having first and second opposed ends, said first end operably coupled to said compressor mechanism;

a bearing mounted on said bearing support and rotatably supporting said shaft proximate said second end of said shaft;

a counterweight rotationally coupled with said shaft and disposed proximate said second end of said shaft;

said housing defining an interior plenum wherein lubricating oil is pooled in a bottom portion of said interior plenum; said bearing support, said bearing, said counterweight and said shaft all being disposed within said interior plenum; and an oil shield, said oil shield having a plurality of flexible members mounting said oil shield to said bearing support proximate said bearing, said flexible members engaged with said bearing support recess, said oil shield having a substantially cylindrical portion extending outwardly from said bearing support, said counterweight being at least partially disposed within said substantially cylindrical portion of said oil shield.

2. The compressor assembly of claim 1 wherein said motor includes a rotor rotationally coupled to said shaft and said counterweight is disposed on said rotor.

3. A compressor assembly comprising;

a housing;

a compressor mechanism disposed within said housing;

a bearing support mounted within said housing;

a shaft rotatable about a shaft axis, said shaft axis being disposed substantially horizontally during operation of said compressor assembly, said shaft having first and second opposed ends, said first end operably coupled to said compressor mechanism;

a bearing mounted on said bearing support and rotatably supporting said shaft proximate said second end of said shaft;

a counterweight rotationally coupled with said shaft and disposed proximate said second end of said shaft;

said housing defining an interior plenum wherein lubricating oil is pooled in a bottom portion of said interior plenum; said bearing support, said bearing, said counterweight and said shaft all being disposed within said interior plenum; and an oil shield, said oil shield having a plurality of flexible members mounting said oil shield to said bearing support proximate said bearing, said oil shield having a substantially cylindrical portion extending outwardly from said bearing support, said counterweight being at least partially disposed within said substantially cylindrical portion of said oil shield, wherein each of said plurality of flexible members has a distal end with a radially inwardly projecting portion, and said bearing support defines a groove proximate said bearing, said inwardly projecting portions being engageable with said groove.

4. A compressor assembly comprising:

a housing;

a compressor mechanism disposed within said housing;

a bearing support mounted within said housing;

a shaft rotatable about a shaft axis, said shaft axis being disposed substantially horizontally during operation of said compressor assembly, said shaft having first and second opposed ends, said first end operably coupled to said compressor mechanism;

a bearing mounted on said bearing support and rotatably supporting said shaft proximate said second end of said shaft;

a counterweight rotationally coupled with said shaft and disposed proximate said second end of said shaft;

said housing defining an interior plenum wherein lubricating oil is pooled in a bottom portion of said interior plenum; said bearing support, said bearing, said counterweight and said shaft all being disposed within said interior plenum; and an oil shield, said oil shield having a plurality of flexible members mounting said oil shield to said bearing support proximate said bearing, said oil shield having a substantially cylindrical portion extending outwardly from said bearing support, said counterweight being at least partially disposed within said substantially cylindrical portion of said oil shield, wherein said bearing support includes a substantially cylindrical central portion, said bearing being mounted within said central portion, said oil shield fixedly engaging an outer surface of said central portion.

5. The compressor assembly of claim 4 wherein said each of said flexible members has a distal end with a radially inwardly projecting portion, and said bearing support defines a groove on said outer surface of said central portion, said inwardly projecting portions being engageable with said groove.

6. A compressor assembly comprising:

a housing;

a stationary scroll member fixed within said housing;

an orbiting scroll member disposed within said housing and engaged with said stationary scroll member;

a motor;

a crankcase disposed between said motor and said orbiting scroll;

a bearing support member fixed within said housing and having a bearing mounted thereto, said bearing support including a recess;

an elongate shaft rotatable about a shaft axis and having a first end and an opposite second end, said shaft extending through said crankcase and said motor, said first end operably coupled with said orbiting scroll, said bearing rotatably supporting said shaft proximate said second end, said shaft axis disposed substantially horizontally during operation of said compressor;

a counterweight rotationally coupled with said shaft proximate said bearing support member;

an oil sump disposed within an interior plenum defined by said housing; and an oil shield, said oil shield having a plurality of flexible members mounting said oil shield to said bearing support, said flexible members engaged with said bearing support recess, said oil shield having a substantially cylindrical portion extending outwardly from said bearing support and encircling at least a portion of said counterweight.

7. The compressor assembly of claim 6 wherein said motor includes a rotor rotationally coupled to said shaft and said counterweight is disposed on said rotor.

8. A compressor assembly comprising:

a housing;

a stationary scroll member fixed within said housing;

an orbiting scroll member disposed within said housing and engaged with said stationary scroll member;

a motor;

a crankcase disposed between said motor and said orbiting scroll;

a bearing support member fixed within said housing and having a bearing mounted thereto;

an elongate shaft rotatable about a shaft axis and having a first end and an opposite second end, said shaft extending through said crankcase and said motor, said first end operably coupled with said orbiting scroll, said bearing rotatably supporting said shaft proximate said second end, said shaft axis disposed substantially horizontally during operation of said compressor;

a counterweight rotationally coupled with said shaft proximate said bearing support member;

an oil sump disposed within an interior plenum defined by said housing; and an oil shield, said oil shield having a plurality of flexible members mounting said oil shield to said bearing support, said oil shield having a substantially cylindrical portion extending outwardly from said bearing support and encircling at least a portion of said counterweight, wherein each of said plurality of flexible members has a distal end with a radially inwardly projecting portion and said bearing support member defines a groove proximate said bearing, said inwardly projecting portions being engageable with said groove.

9. A compressor assembly comprising:

a housing;

a stationary scroll member fixed within said housing;

an orbiting scroll member disposed within said housing and engaged with said stationary scroll member;

a motor;

a crankcase disposed between said motor and said orbiting scroll;

a bearing support member fixed within said housing and having a bearing mounted thereto;

an elongate shaft rotatable about a shaft axis and having a first end and an opposite second end, said shaft extending through said crankcase and said motor, said first end operably coupled with said orbiting scroll, said bearing rotatably supporting said shaft proximate said second end, said shaft axis disposed substantially horizontally during operation of said compressor;

a counterweight rotationally coupled with said shaft proximate said bearing support member;

an oil sump disposed within an interior plenum defined by said housing; and an oil shield, said oil shield having a plurality of flexible members mounting said oil shield to said bearing support, said oil shield having a substantially cylindrical portion extending outwardly from said bearing support and encircling at least a portion of said counterweight, wherein said bearing support member includes a substantially cylindrical central portion, said bearing being mounted within said central portion, said oil shield fixedly engaging an outer surface of said central portion.

10. The compressor assembly of claim 9 wherein said each of said flexible members has a distal end with a radially inwardly projecting portion, and said bearing support member defines a groove on said outer surface of said central portion, said inwardly projecting portions being engageable with said groove.

11. A compressor assembly comprising:

a housing;

a compressor mechanism disposed within said housing;

a shaft rotatable about a shaft axis, said shaft operably coupled to said compressor mechanism;

a bearing support member mounted within said housing, said bearing support member rotatably supporting said shaft;

a counterweight rotationally coupled with said shaft;

said housing defining an interior plenum wherein lubricating oil is pooled in a bottom portion of said interior plenum, said bearing support member, said counterweight and said shaft all being at least partially disposed within said interior plenum; and an oil shield, said oil shield having a plurality of flexible members mounting said oil shield to said bearing support, said counterweight being at least partially disposed within said oil shield;

wherein each of said plurality of flexible members has a distal end with a radially inwardly projecting portion, wherein said bearing support member defines a groove, and wherein said inwardly projecting portions are engaged with said groove.

12. The compressor assembly of claim 11 wherein said bearing support member includes a substantially cylindrical central portion, and wherein said oil shield is fixedly engaged with an outer surface of said central portion.

13. The compressor assembly of claim 12, wherein said groove is defined on said outer surface of said central portion, and wherein said inwardly projecting portions are engaged with said groove.

* * * * *

UNITED STATES PATENT AND TRADEMARK OFFICE

CERTIFICATE OF CORRECTION

Figure 2:
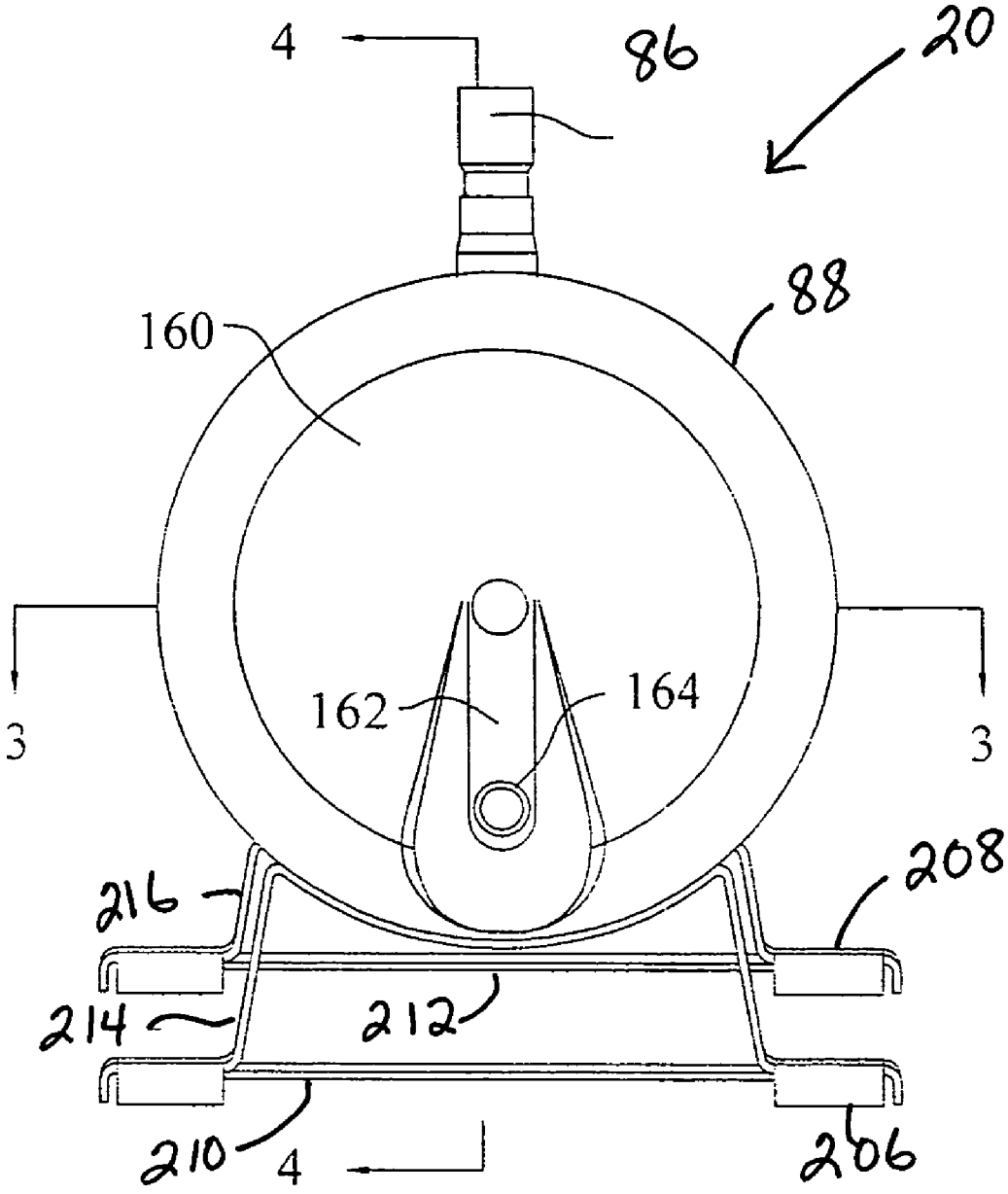
FIG. 2 is an end view of the compressor of FIG. 1.

PATENT NO. : 7,094,043 B2
APPLICATION NO. : 10/657310
DATED : August 22, 2006
INVENTOR(S) : Robin G. Skinner It is certified that error appears in the above-identified patent and that said Letters Patent is hereby corrected as shown below:

The sheet of drawing consisting figure 2 should be deleted to appear as per attached figure 2.

Signed and Sealed this

Nineteenth Day of December, 2006

JON W. DUDAS
*Director of the United States Patent and Trademark Office*